United States Patent [19]

Sawyer

[11] 4,213,497

[45] Jul. 22, 1980

[54] METHOD FOR CASTING DIRECTIONALLY SOLIDIFIED ARTICLES

[75] Inventor: Thomas F. Sawyer, Ballston Lake, N.Y.

[73] Assignee: General Electric Company, Schenectady, N.Y.

[21] Appl. No.: 935,588

[22] Filed: Aug. 21, 1978

[51] Int. Cl.[2] ..... B22D 25/06

[52] U.S. Cl. ..... 164/60; 164/127

[58] Field of Search ..... 164/60, 125, 126, 127, 164/361, 338 R, 338 M; 156/616 R

[56] References Cited

U.S. PATENT DOCUMENTS

| | | | |
|---|---|---|---|
| 3,342,455 | 9/1967 | Fleck et al. | 164/125 X |
| 3,580,324 | 5/1971 | Copley et al. | 164/60 |
| 3,598,169 | 8/1971 | Copley et al. | 164/60 |
| 3,633,648 | 1/1972 | Barrow et al. | 164/60 |
| 3,939,895 | 2/1976 | Sawyer | 164/60 |
| 4,062,399 | 12/1977 | Lirones | 164/361 X |

*Primary Examiner*—Robert D. Baldwin
*Assistant Examiner*—J. Reed Battên, Jr.
*Attorney, Agent, or Firm*—F. Wesley Turner; James C. Davis, Jr.; Leo I. MaLossi

[57] ABSTRACT

In a directionally solidified alloy casting operation the retractor is securely attached to the ingot mold by means also enabling easy separation of the resulting ingot from the retractor.

4 Claims, 4 Drawing Figures

METHOD FOR CASTING DIRECTIONALLY SOLIDIFIED ARTICLES

BACKGROUND OF THE INVENTION

Superalloys are heat resistant materials having superior strength and oxidation resistance at high temperatures. Many of these alloys contain iron, nickel or cobalt alone or in combination as the principal element, together with chromium to impart surface stability and usually containing only one or more minor constituents such as molybdenum, tungsten, columbium, titanium and aluminum for the purpose of effecting strengthening. The physical properties of the superalloys make them particularly useful in the manufacture of gas turbine components.

The strength of superalloys is determined in part by their grain size. At low temperatures fine grained equiaxed structures are preferred. At high temperatures large-grained size structures are usually found to be stronger than fine-grained. This is believed related to the fact that failure generally originates at grain boundaries oriented perpendicular to the direction of the induced stress. By casting a superalloy to produce an elongated columnar structure with unidirectional crystals aligned substantially parallel to the long axis of the casting, grain boundaries normal to the primary stress axis can be almost completely eliminated. Further, by making a single crystal casting of a superalloy, such failure under stress is entirely eliminated.

Directional solidification to produce columnar casting and the apparatus used for this purpose are described in The Superalloys, Edited by C. T. Sims et al., John Wiley & Sons, (1972), pages 479–508. Columnar grains are formed when the melt temperature is greater than the freezing temperature and when the flow of heat is unidirectional from the liquid through the solid. Typically a ceramic investment casting mold is attached to a water-cooled copper chill plate and placed in an induction-heated graphite susceptor or resistance heated furnace. The mold is heated above the melting point of the alloy being cast and a superheated melt is poured into the mold. Heat enters the upper portion of the mold by radiation from the susceptor or other heat source and is removed through the solidified metal by the chill at the bottom. Thus, solidification occurs in an upward direction through the casting and the rate of solidification is a function of the amount of heat entering at the top of the casting and the amount of heat extracted from the casting through the solid. In the Stockbarger method the furnace heat-flow configuration requires a sharp temperature difference between the lower and upper furnace portions which is provided by a baffle. The mold is gradually withdrawn through the baffle so that the solid-liquid interface remains essentially parallel with the place of the baffle.

The temperature gradient in any directional solidification apparatus is a major factor which regulates the maximum rate unidirectional solidification can occur while maintaining good phase alignment throughout the length of the ingot. An increase in growth velocity requires an increase in temperature gradient in order to maintain the same temperature gradient to growth velocity. The Bridgman-type apparatus has been used to produce acceptable phase alignment of certain alloys but only at very low solidification rates of about ¼ inch per hour. In furnaces which do not have pour capability the susceptor is heated inductively, which melts the charge in the crucible. After equilibrium is established, the mold assembly is lowered out of the heat zone and nucleation of solid occurs in the bottom of the crucible. Directional freezing continues upward as the mold unit is lowered. Faster rates at this inherent temperature gradient introduces structure breakdown to cellular and/or dendritic morphologies which deleteriously affects the properties. Bottomless crucibles which allow contact between the ingot and a copper chill have increased the allowable solidification but the heat path may still be interrupted by oxide formation at the contact site or poor contact between the ingot and the chill due to surface roughness, lack of alignment or separation due to shrinkage of the ingot during cooling.

The conditions at the chill face are critical for proper unidirectional heat flow. The chill should be water cooled and have a high thermal conductivity. The surface of the chill must be cleaned before each casting run so that resistance to heat flow by oxide layers is minimized. Difficulties in obtaining uniform heat transfer at the chill face require that the mold be securely clamped to the chill plate. A major problem with this method is that solidification rate and temperature gradient decrease with distance from the chill.

In accordance with my earlier invention described in U.S. Pat. No. 3,939,895, I provided a method of producing a directionally solidified cast alloy article in a shell mold. The method includes providing a mold having a cavity divided into an upper portion and a lower portion, the mold being disposed in a heating zone, placing one end of a longitudinal heat extractor element of said alloy into the lower portion of the cavity, said other end of said heat extractor extending therefrom and being exposed to a continuous flow of fluid coolant, heating said mold and said one end of said heat extractor placed therein at a temperature above the melting range of said alloy to melt a portion of said one end of the heat extractor, filling the mold with said alloy in a molten state and controllably lowering said mold out of the heating zone to allow the mold and contents thereof to cool and to establish directional solidification of the alloy in said cavity.

Summary of the Invention

I have now discovered that my method can be improved upon by means of a retractor which can be securely attached to the ingot mold to provide for continuous heat withdrawal and yet be easily removed from the ingot after the casting is complete. More particularly, the invention is a method of producing a directionally solidified cast alloy article in a shell mold, said method comprising (a) providing a ceramic mold having a cavity divided into an upper portion and a lower portion, (b) providing a metallic retractor having a reentrant recess in its upper position, (c) forming a liner of relatively frangible and heat-resistant thermally-conductive ceramic material in said recess, (d) assembling the mold and retractor together with the mold cavity and retractor recess in register, (e) filling said mold with molten alloy metal in a heating zone at a temperature above the melting point of said metal whereby molten metal is caused to flow into and fill the retractor recess within the liner, (f) moving the assembly downwardly relative to the heating zone to cause cooling and to establish directional solidification of the alloy in said cavity, and (g) breaking the liner and removing the resulting cast article from the retractor.

DETAILED DESCRIPTION OF THE INVENTION

Figure 1:
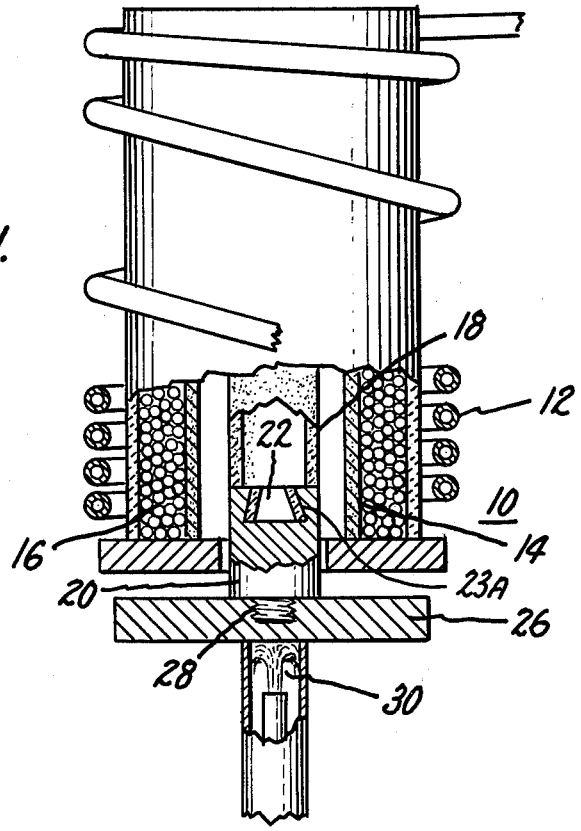
FIG. 1 is a schematic illustration of a furnace chill plate and retractor for use in the invention.

Referring now to the drawings, and particularly FIG. 1, the furnace 10 conventionally used for a directional solidification is heated from outside by induction heating coils 12. Within the furnace 10 is a susceptor 14 comprised of graphite or a similar material which is insulated with an insulation 16 of a ceramic material. Disposed within the susceptor is a shell mold 18 which is formed of a ceramic or similar material. The top portion of the mold is provided with an opening in to which the molten alloy may be poured while the bottom portion of the mold is adapted to receive retractor 20 having reentrant axial recess 22 fitted with a tubular ceramic liner 23A. Mold 18 and retractor 20 as thus assembled may preferably be temporarily attached by any suitable temperature-resistant adhesive material such as the ceramic cement used to provide liner 23A. Retractor 20 engages chill plate 26 by means of a threaded portion 28. Chill plate 26 is water cooled on its bottom through a channel located at 30. The furnace including or excluding the induction coils may be placed in a chamber to control the atmosphere and thus prevent oxidation of the melt.

In the operation of the furnace the mold assembly is preheated to a sufficiently high temperature to insure that the alloy in upper portion of the retractor remains molten while at the same time water cooling is established. The power setting and position of the mold assembly in the susceptor will govern the length of the melt-back into the heat retractor. When the predetermined settings have allowed the system to equilibrate, the desired alloy is melted in a crucible positioned above the mold using a separate power source.

The entire mold assembly is then lowered at a preselected rate. The solid-liquid interface will advance upward as heat is conducted through the retractor and carried away by water flowing at its base.

Liquid alloy which flows into liner 23A in recess 22 solidifies rapidly as the retractor is outside of the furnace. Because of the frustro-conical configuration of the liner, the solidified ingot is locked into the retractor so that good contact is made at all times with the chill plate, liner 23A being of material having good thermal conductivity characteristics. When the mold is fully withdrawn from the furnace, the ingot is easily removed from the retractor by breaking the ceramic liner 23A. Inasmuch as the diameter of bottom of recess 22 is greater than that of the top and liner 23A is of conforming shape and substantially uniform wall thickness over its length, shell mold 18 and casting therein are securely joined to retractor 20 throughout the heat treatment period. Thereafter shell mold 18 and the new casting are readily separated and removed from the retractor by breaking liner 23A, the lower end of the new casting within recess 22 being of lesser diameter than the open upper end of the recess.

Figure 2:
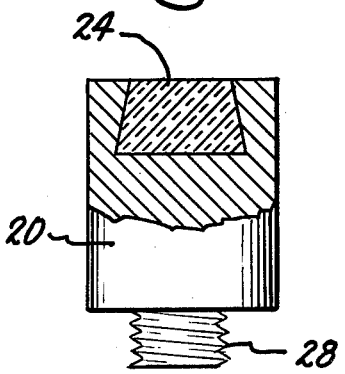
FIG. 2 is a retractor having a threaded end attachment to a chill plate and having its depression filled with a ceramic cement.
Figure 3:
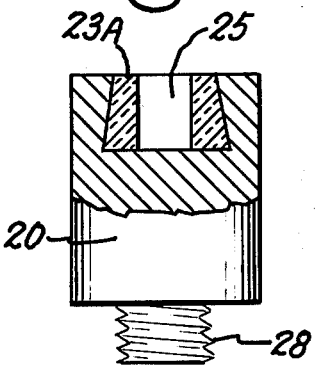
FIG. 3 depicts the retractor in which the ceramic cement has been partially removed from the depression.
Figure 4:
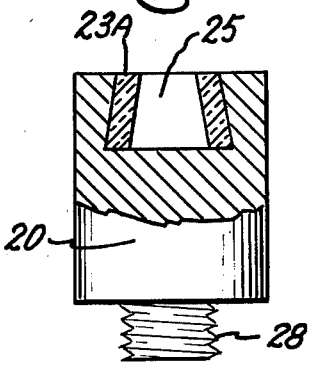
FIG. 4 depicts the retractor in which the ceramic cement has been further removed to provide tapered sides.

The formation of the retractor is illustrated by FIGS. 2, 3 and 4. In FIG. 2, recess 22 is shown completely filled with ceramic cement mold 24. In FIG. 3, a portion of the cement is removed by means of a cork boring tool to provide a cylindrical axially-extending bore 25 reaching the bottom of recess 22. In FIG. 4, bore 25 is further enlarged to form body 23A having tapered sides and uniform wall thickness. Sufficient ceramic cement is retained however, to insure that the diameter of the portion of the casting within recess 22 will not be greater than diameter of the open end of the recess when body 23A is broken and removed.

Conventional ceramic materials can be employed to form a tapered cavity in the retractor, to form the mold and to cement the mold to the retractor. The retractor is of course formed of a metal, preferably an excellent thermal conductor.

Using the apparatus and method of the present invention, unidirectionally solidified nickel-base carbide reinforced cast superalloy bodies having high strength and high stress rupture properties particularly at elevated temperatures are prepared as disclosed by Walter et al., U.S. Pat. No. 3,793,012. The reinforced fibers present in the matrix are aligned single crystal fibers of metal monocarbides. The range of compositions of the unidirectionally solidified castings in weight percent is about 6.5–10% chromium, 14–23% tantalum, 0.5–1.5% carbon, up to 6% aluminum, up to 1% titanium, up to 8.5% cobalt, up to 5.0% molybdenum, and the balance essentially nickel. A preferred composition, designated as TaC-1900 has high strength and high stress-rupture properties. The nickel-base superalloy can also be modified as disclosed by Walter, U.S. Pat. application Ser. No. 482,589, filed June 24, 1974, now U.S. Pat. No. 3,944,416 and having the same assignee as the instant application, to include by weight at least 2% rhenium, and at least 6% tungsten, but containing less than 5% aluminum and less than 7% chromium and aligned reinforced fibrous phase of tantalum monocarbide embedded in the matrix.

Other alloys which can be employed in my process are cobalt-base tantalum carbide eutectic alloys as disclosed by Walter et al, U.S. Pat. No. 3,793,013 and having a composition in weight percent of up to 26% chromium, 13.5–19.0% tantalum, up to 10.0% nickel, up to 6.5% tungsten, up to 1% iron, 1.2–1.5% carbon and the balance essentially cobalt.

The material used to provide relatively frangible, thermally conductive frustro-conical body 23A and to join the retractor 20 to the shell mold 18 may suitably be a ceramic cement such as formed from Norton 1139 alumina refractory cement and water, as indicated above. In the best practice of this invention, however, the retractor can be joined to the shell mold by a low temperature quick setting stronger adhesive such as formed from pure alumina and potassium silicate binder. The shell mold can be formed by intermittently submerging a wax pattern in a slurry of alumina and silica followed by dusting with a coarse alumina grit and repeated until the desired thickness of the shell is reached such as about 3/16"–¼" thick. A suitable procedure is described in U.S. Pat. No. 4,024,300 issued to Svec.

I claim:

1. a method for producing a directionally solidified cast alloy article in a shell mold, said method comprising:

(a) providing a ceramic mold having a cavity divided into an upper portion and a lower portion, (b) providing a metallic retractor having a reentrant recess in its upper position, (c) forming a liner of relatively frangible and heat-resistant thermally-conductive ceramic material in said recess, (d) assembling the mold and retractor together with the mold cavity and retractor recess in register, (e) filling said mold with molten alloy metal in a heating zone at a temperature above the melting point of said metal whereby molten metal is caused to flow into and fill the retractor recess within the liner, (f) moving the assembly downwardly relative to the heating zone to cause cooling and to establish directional solidification of the alloy in said cavity, and (g) breaking the liner and removing the resulting cast article from the retractor.

2. The method of claim 1, wherein said mold is shaped to produce a gas turbine blade.

3. The method of claim 1, wherein the retractor recess liner is an alumina refractory cement.

4. The method of claim 1, wherein the retractor is temporarily attached to the mold by means of an alumina refractory cement and a potassium silicate binder.

* * * * *